US006964540B1

(12) United States Patent
Foxwell

(10) Patent No.: US 6,964,540 B1
(45) Date of Patent: Nov. 15, 2005

(54) VARIABLY ADJUSTABLE WATERCRAFT RAMP

(76) Inventor: Robert D. Foxwell, 6549 Harbor Pl., Prior Lake, MN (US) 55372

( * ) Notice: Subject to any disclaimer, the term of this patent is extended or adjusted under 35 U.S.C. 154(b) by 28 days.

(21) Appl. No.: 10/674,638

(22) Filed: Sep. 29, 2003

Related U.S. Application Data

(60) Provisional application No. 60/414,903, filed on Sep. 30, 2002.

(51) Int. Cl.[7] ..... B63C 3/00
(52) U.S. Cl. ..... 405/1; 403/374.3
(58) Field of Search ..... 405/3, 2, 86; 114/44–48; 403/373, 381, 374.2, 374.3, 374.4; 384/58, 384/59

(56) References Cited

U.S. PATENT DOCUMENTS 2,531,770 A * 11/1950 Ducharme ..... 405/2
2,696,139 A 12/1954 Attwood
2,784,812 A * 3/1957 Kindorf ..... 403/22
2,827,188 A * 3/1958 Rovil ..... 414/478
2,860,792 A * 11/1958 Nelson et al. ..... 414/535
2,887,203 A * 5/1959 Baron ..... 193/37
2,889,946 A * 6/1959 Holsclaw ..... 414/534
3,035,723 A * 5/1962 Brosch ..... 414/529
3,049,161 A 8/1962 Attwood
3,053,355 A 9/1962 Attwood
3,077,277 A * 2/1963 Holzman ..... 414/534
3,104,770 A * 9/1963 Calkins et al. ..... 414/531
3,117,683 A * 1/1964 Kleppe ..... 414/534
3,146,599 A 9/1964 Young
3,221,899 A 12/1965 Gronlund
3,227,292 A 1/1966 Jacobs
3,539,066 A * 11/1970 Stevenson ..... 414/483
3,547,285 A * 12/1970 Plummer ..... 414/534
3,587,874 A 6/1971 Graf
3,785,677 A * 1/1974 Calkins ..... 280/414.1
3,842,998 A * 10/1974 Borum ..... 414/529
3,888,367 A * 6/1975 Cox ..... 414/534
3,908,330 A 9/1975 Frach et al.
3,917,087 A * 11/1975 Godbersen ..... 414/534
3,974,924 A 8/1976 Ullman, Jr.
4,035,097 A 7/1977 Bachand
4,408,928 A * 10/1983 Steinke ..... 403/320
4,453,881 A * 6/1984 Cowley ..... 414/534
4,482,268 A * 11/1984 Stevenson et al. ..... 405/3
4,507,016 A 3/1985 Honour, VII
4,592,694 A * 6/1986 Johnson ..... 414/534
4,781,515 A * 11/1988 Johnson ..... 414/534

(Continued)

OTHER PUBLICATIONS

Minnesota picture of boat ramp having a single spine.
VE-VE boat ramp sales sheet showing three models.

*Primary Examiner*—Heather Shackelford
*Assistant Examiner*—Gay Ann Spahn
(74) *Attorney, Agent, or Firm*—R. C. Baker & Associates, Ltd.

(57) ABSTRACT

The watercraft ramp comprises a frame and a plurality of hull-support assemblies mounted thereon. The frame has a pair of elongated channel rails held in laterally spaced condition. Each rail has a longitudinally aligned internal recess and a longitudinally aligned elongated slot for access into the internal recess. The slot is narrower than the transverse width of the recess. Each hull-support assembly has a mounting bracket, a fastener for fixing the bracket on a rail, and at least one hull roller. The fastener has a locking part that extends through the rail slot into the internal rail recess for locking engagement to the rail at any desired location. A stabilizer part on the bracket cooperatives with the slot to maintain alignment of the bracket on the rail.

18 Claims, 6 Drawing Sheets

U.S. PATENT DOCUMENTS 4,784,552 A 11/1988 Rebentisch
4,802,685 A * 2/1989 Godbersen ..... 280/414.1
4,830,531 A 5/1989 Condit et al.
4,900,051 A * 2/1990 Godbersen ..... 280/414.1
4,900,216 A * 2/1990 Godbersen ..... 414/534
4,911,459 A * 3/1990 Smyly, Sr. ..... 280/414.1
4,986,571 A * 1/1991 Godbersen ..... 280/854
4,997,332 A 3/1991 Johnson
5,066,033 A * 11/1991 Kolstad et al. ..... 280/414.1
5,184,913 A 2/1993 Meriwether
5,213,443 A * 5/1993 Hemperly et al. ..... 405/3
5,228,713 A * 7/1993 Kovach ..... 280/414.1
5,255,933 A * 10/1993 Carrick ..... 280/414.1
5,316,329 A * 5/1994 MacKarvich ..... 280/414.1
5,400,733 A 3/1995 Richter
5,449,247 A * 9/1995 Smith ..... 405/3
5,737,801 A * 4/1998 Flood ..... 16/30
5,951,231 A * 9/1999 Allen ..... 414/462
6,092,961 A 7/2000 Kilgore
6,116,176 A * 9/2000 Jones ..... 114/67 R
6,182,597 B1 2/2001 Maxwell et al.
6,290,426 B1 * 9/2001 van Gijsel et al. ..... 403/374.3
6,327,990 B1 * 12/2001 Crifase et al. ..... 114/219
6,520,728 B1 2/2003 Schwitters
6,572,057 B1 * 6/2003 Roth ..... 248/58
6,592,291 B2 * 7/2003 Foxwell ..... 405/1
6,612,602 B1 * 9/2003 MacKarvich ..... 280/414.1
2002/0078876 A1 * 6/2002 Ockels ..... 114/344
2002/0114668 A1 * 8/2002 Legleux ..... 405/3
2003/0155748 A1 * 8/2003 Picard et al. ..... 280/656
2004/0089213 A1 * 5/2004 Godbersen ..... 114/44

* cited by examiner

VARIABLY ADJUSTABLE WATERCRAFT RAMP

CROSS REFERENCE TO RELATED APPLICATION

This application claims the priority benefit of provisional application Ser. No. 60/414,903, filed Sep. 30, 2002.

FIELD OF THE INVENTION

This invention relates to a variably adjustable watercraft ramp, and more particularly to a watercraft ramp wherein the spacing and location of hull-support assemblies along the length of a channel rail can be varied by a user to an essentially infinite extent to satisfy the user's desire for ideal hull support.

BACKGROUND OF THE INVENTION

Watercraft innovations in recent years have lead to the creation of a multitude of variations in hull design with consequent desire by users for variations in ramp design in their quest to protect their watercraft against potential damage when it is temporarily stored (i.e., parked) out of the water on a ramp during periods of non-use. It is gradually becoming economically impracticable for a supplier of ramps to market every conceivable variation to satisfy various customer predilections. Nevertheless, to the extent known, no one heretofore has ever figured out a way to make an economically practical watercraft ramp capable of having its hull-support assemblies essentially infinitely adjustable along the length of a channel rail, and to make the spacing of channel rails themselves also conveniently adjustable so as to permit a consumer or user to achieve essentially infinite location variations for hull-support assemblies to satisfy the user's predilection. It is to a solution of this problem that this invention is directed.

SUMMARY OF THE INVENTION

The invention provides a watercraft ramp comprising a frame and a plurality of hull support assemblies. The frame has at least one pair of elongated channel rails held in laterally spaced condition. Each rail has a longitudinally aligned internal recess and a longitudinally aligned elongated slot for access into the internal recess. The hull support assemblies are mountable in varied spaced relationship to each other on the channel rails. Each hull support assembly comprises a mounting bracket, a fastener for fixing the bracket on the rail, and at least one hull roller for supporting a watercraft. Each fastener includes a locking part that is movable through a rail slot into the internal recess of the rail for locking engagement of the bracket to the rail at any desired location along the rail slot. The bracket has a stabilizer part cooperative with the rail slot to help maintain alignment of the bracket on the rail.

The ramp can be looked upon as having a water end and a shore end. The water end can also be called the entry end and the shore end called the stop end. The hull-support assemblies can be mounted on an elongated channel rail at any point along the slot of the elongated length of the channel rail. The mounting of a hull-support assembly on a channel rail using the teachings of this invention can be accomplished using a simple fastener to affix a hull-support assembly to the channel rail. An ideal hull-support assembly of the invention has a bracket with parallel upward flanges for holding at least one hull-support roller and downward stabilizing flanges that are capable of a cooperative relationship with the channel rails so that only one fastener can hold the bracket in properly oriented condition on the channel rail at any desired location along the length of that rail.

Another special feature of the invention is that of telescoping cross braces for holding the channel rails in parallel spaced condition. Still further, a telescopable winch mount beam is contemplated by the invention; and a simple metal strap bent appropriately to extend over the winch mount beam at a mid-location between its ends and anchored (at strap ends) to a cross brace at the shore end of the ramp is completely effective to hold the winch mount beam against unwanted tilt during winch operation to pull a watercraft onto the ramp.

Still other benefits and advantages and features of the invention will be evident as this description proceeds.

DESCRIPTION OF THE PREFERRED EMBODIMENTS

Figure 1:
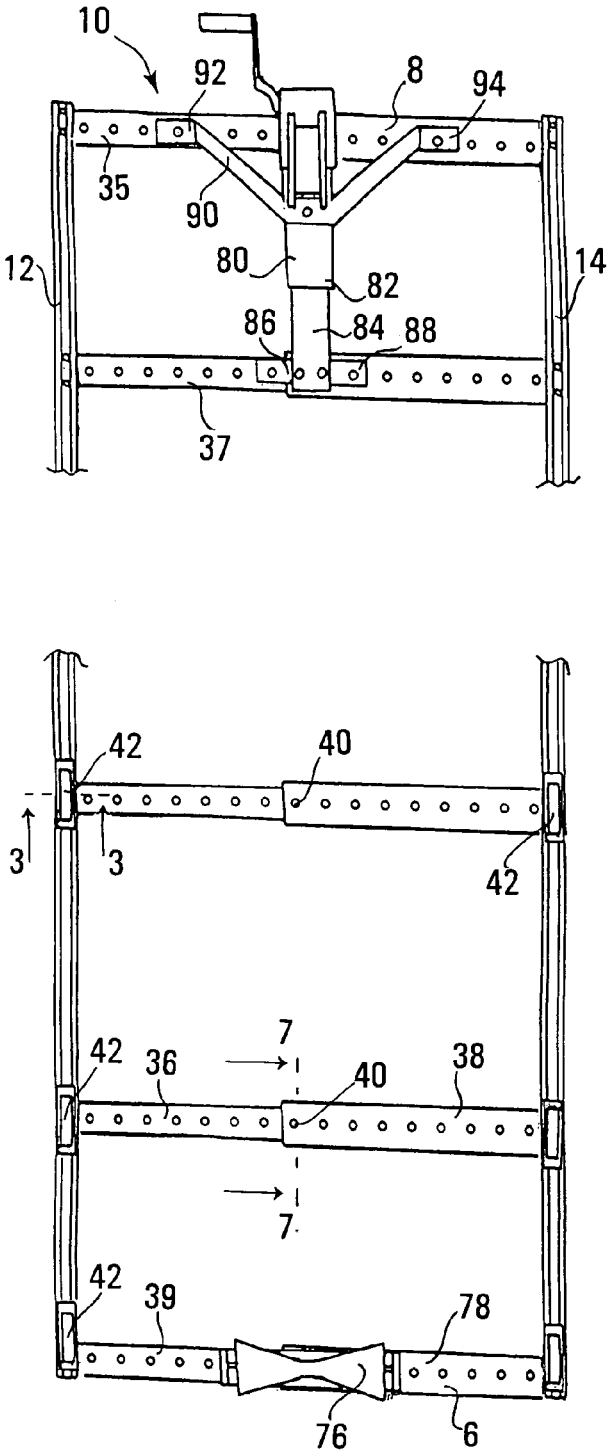
FIG. 1 is a schematic top plan view of the new watercraft ramp of the invention with a portion broken away to avoid duplication of repetitive features along the length of the ramp.
Figure 2:
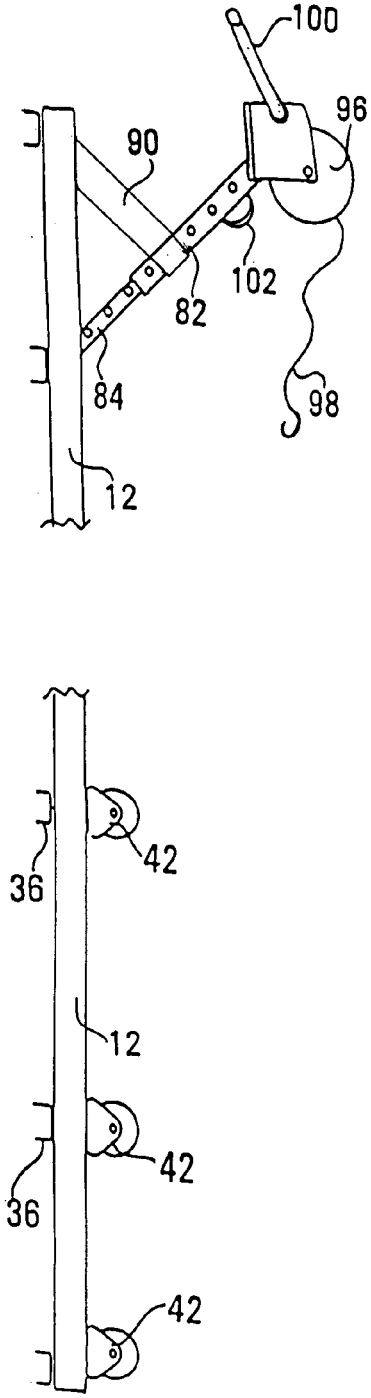
FIG. 2 is a schematic side plan view of the showing in FIG. 1, with a portion broken away comparable to that broken away in FIG. 1.
Figure 7:
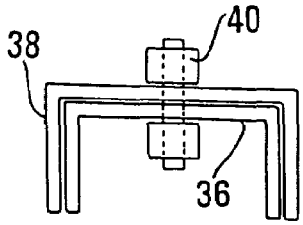
FIG. 7 is a cross-sectional view taken on line 7—7 of FIG. 1 and illustrates the telescoping of cross brace members.

Referring particularly to FIGS. 1 and 2, the new ramp 10 as illustrated has a water end 6 that is normally placed on the shoreline or into the water, plus a shore end 8 that is normally on dry land well up from the shoreline; a more appropriate characterization of the opposite ends can be "entry end" for the water end and "stop end" for the shore end. The ramp has channel rails 12 and 14 that are laterally spaced apart and held in laterally spaced condition by cross brace beams. The cross brace beams are preferably telescoping in nature (to permit varied lateral spacing of the rails) with a male cross brace part 36 of U shape telescoped within female cross brace part 38 of U shape. See FIGS. 1 and 7. One or more fasteners 40 of a nut and bolt character are used at the overlap of the mating parts 36 and 38 to fix the parts together. Hull-support roller assemblies 42 are mounted anywhere on the channel rails.

Figure 4:
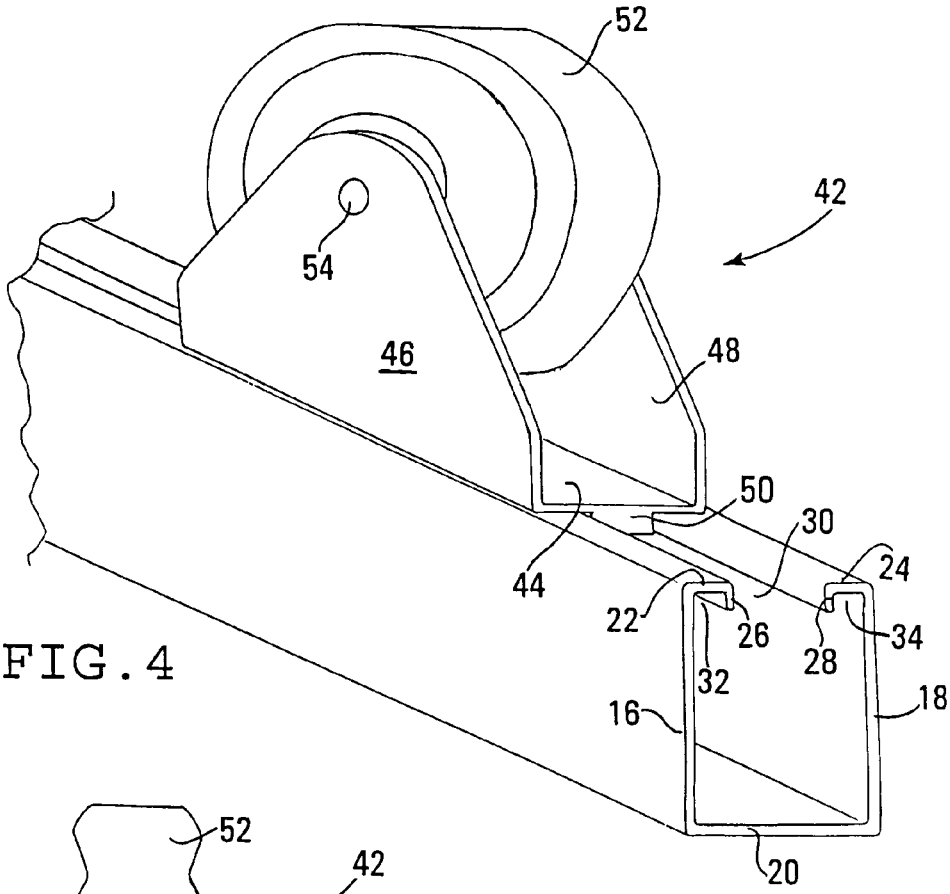
FIG. 4 is a schematic perspective view of a hull-support roller assembly on a channel rail in accordance with the teachings of the invention, with the channel rail broken away at one end and sectioned at the other in order to better illustrate details for the channel rail itself.
Figure 3:
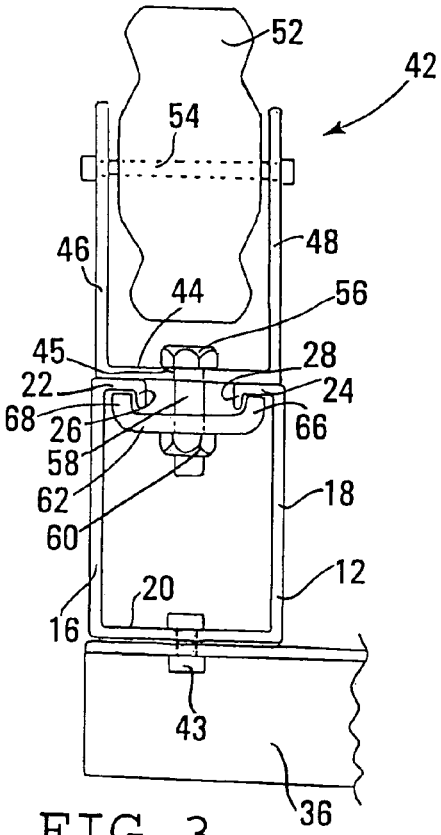
FIG. 3 is a cross-section taken from line 3—3 of FIG. 1 and illustrates the fastening of a hull-support assembly to a channel rail.

The nature of the elongated channel rails is best understood by reference to FIGS. 3 and 4 where channel rail 12 is illustrated. These elongated channel rails have longitudinally extending parallel side walls 16 and 18. Each side wall has a longitudinal bottom edge and a longitudinal top edge. A unitary floor wall extends between the bottom edges as a simple floor wall 20. It has a hole or series of holes in it for fastening to cross brace beams as at part 36. See FIGS. 1–3. Nut and bolt fasteners 43 are suitable. The top structure of these rails is formed by border flanges 22 and 24 which project or extend inwardly from the top edge of the side walls, and these inwardly projecting border flanges have downwardly directed lip flanges 26 and 28 along their inner edges. The downwardly directed lip flanges 26 and 28 point toward the floor 20 of the channel rail. More significantly, the downwardly directed lip flanges 26 and 28 define a longitudinal slot 30 (see FIG. 4) in the top of the channel rail. Internal lock recesses 32 and 34 (see FIG. 4) are thus formed and are bordered or defined by the border flanges 22 and 24 and the lip flanges 26 and 28 as well as the upper part of the side walls 16 and 18. The longitudinal elongated rail slot 30 is narrower in width than the width of the longitudinally aligned internal recess of the channel rail. The width of the internal recess is defined by the inside surfaces of the side walls 16 and 18. It should be recognized that the floor wall 20, side walls 16 and 18, border flanges 22 and 24, and lip flanges 26 and 28 all have inner or interior surfaces as well as outer or exterior surfaces. A lip flange outer surface is the surface defining the slot entry into the interior of the channel rail.

As illustrated in FIGS. 3 and 4, the hull-support roller assemblies 42 have a very special mounting bracket. In simplified form, the mounting bracket has an elongated floor panel 44 equipped with a fastener hole 45 extending vertically therethrough and available to receive the shaft 58 of a nut and bolt type fastener. Two spaced parallel upright flanges 46 and 48 (e.g., of the "ear" type) extend upwardly from the bracket floor 44. Preferably these flanges extend up from the elongated sides of the floor 44 when the bracket is for a single roller 52. Further, at least one and preferably two stabilizer flanges depend or project downward from the floor 44 and particularly at the ends of the elongated floor 44. Only one stabilizer flange 50 is illustrated in FIG. 4 of the drawings, but an additional stabilizer flange is preferably located at the opposite end of the floor 44 and depends downwardly from that opposite end. The stabilizer flanges are for entry into (i.e., they extend into) the elongated slot 30 of the channel rails and prevent rotary movement of entire hull-support roller assemblies 42 even when the hull-support roller assemblies are fixed in position along the channel rails by a single fastener. In essence, the stabilizer flanges help to maintain watercraft support orientation for the assembly 42.

Figure 5:
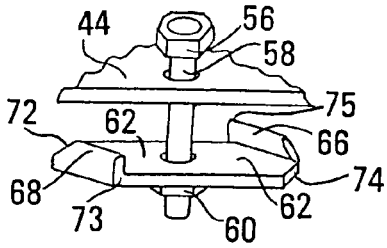
FIG. 5 is a schematic perspective view of the fastener for holding the bracket of a hull-support roller assembly on a channel rail according to the invention.

A single fastener is best illustrated in FIGS. 3 and 5. It has two major parts threadedly fastenable together along an axis common to each part. One part has a head end 56 with a threaded shaft 58 united to it and projecting inwardly toward the other part (i.e., projecting downwardly as illustrated in FIG. 3). The other part is a threaded nut end 60 with an inward side (toward head 56) for threaded fastening axially on the threaded shaft 58. Either the head end 56 or the nut end 60 has a transverse plate extending radially outward therefrom and integrally united thereto so as to be oriented transverse to the axis of fastening for the fastener parts. As illustrated in FIG. 3 and FIG. 5, a transverse plate 62 extends radially outward from the nut at the end 60. In fact, the transverse plate may itself be provided with an internal threaded bore to serve as a nut per se, although it is equally suitable to unite a nut to the plate by any suitable means (such as spot welding when a metal plate and nut are used). The important point to keep in mind is that the transverse plate extends radially outward from the head end or the nut end. The end carrying the plate 62 is always placed on the outer or exterior side of the floor 44 of the bracket of the roller assembly. (If the transverse plate is put on the head end of the fastener, one reverses the head and nut ends as illustrated in FIG. 3 and then one threads the nut end on the threaded shaft 58.)

There are some critical features about the transverse plate 62. See FIGS. 3, 5, and 6. First of all, it has a generally rectangular shape, although it may lean toward a parallelogram shape and may have portions of the outer edges of the shape eaten or cut out. It must have at least one perpendicularly extending locking protrusion 66 or 68 capable of entry into a locking recess 32 or 34 of the channel rail. (This locking protrusion may be formed by cutting or molding a groove in a thick plate to permit the lip flange to enter the same and thus cause the thicker edge part of the plate to be a locking protrusion that enters the locking recess formed by the lip flange, as will be further explained.) The plate is longer than it is wide. The two outer corners 73 and 75 of the shape are at maximum radial distance from the axis center of the plate 62. These two angular outer corners are diagonally across the plate 62. They can be referred to as relatively pointed (or "stop") diagonal outer corners 73 and 75. The other diagonal "corners" or edges 72 and 74 are preferably, as illustrated in FIG. 5, non-pointed and have a sloped or curved outer edge of shorter radial distance from the hole in the center of plate 62 (as compared to the distance for the corners 73 and 75). Importantly, the width of the plate 62 is less than the width of the slot 30 of the channel rail, so that the plate 62 will pass through the elongated slot 30 when the plate is oriented with its length parallel to the elongated channel rail slot.

In use, the bolt-like fastener is first assembled as illustrated in FIG. 5, with the threaded shaft 56 through a bolt hole in the floor 44 of the bracket for a hull roller assembly. The key point is that the part of the fastener carrying plate 62 must be on the outer side (i.e., lower side as illustrated) of the floor 44. The plate must be oriented with its surface carrying the perpendicularly extending locking protrusion facing the mating part of the bolt-like fastener. In the illustration of FIG. 5, the head 56 of the fastener carries the threaded shaft 58 and the nut end 60 of the fastener carries the plate 62. Therefore, the nut end that carries plate 62 is threadedly attached to the tip of shaft 58 after the shaft is passed through bracket floor panel 44 (with the head end 56 at the upper interior of the floor panel). This assembly (as illustrated in FIG. 5) is made while the hull roller 52 (see FIG. 4) and its axis shaft formed by bolt and nut 54 are not present or are removed from the upward hull roller support flanges 46 and 48 of the bracket. Their absence makes it easier to form the assembly of elements as illustrated in FIG. 5. It is only after the assembly of FIG. 5 is formed that the plate 62 of that assembly is oriented with its length parallel to slot 30 of the channel rail and then passed through the slot into the interior of the channel rail.

Once the plate 62 of the FIG. 5 assembly is through the slot, the bracket downward stabilizer flanges 50 at opposite ends of floor panel 44 are nested in the slot 30 to hold the hull roller bracket in alignment on the channel rail. Then the step of tightening the fastener is next, and this involves rotating the head end 56 (which is readily accessible, whereas the nut end is not) in a clockwise manner. Turning the head 56 of the bolt will in turn rotate plate 62 into a transverse orientation with respect to the elongated channel rails. See FIG. 6 where plate 62 is illustrated in an intermediate stage of turning. Sloped diagonal corners 72 and 74 facilitate easy movement of the plate 62 in a rotary fashion past the inner surfaces of side walls 16 and 18 upon rotation of bolt head 56. But the length of plate 62 at the terminal ends of its length (and specifically at its radially outermost diagonal corners 73 and 75) abuts against the inner surface of the side walls 16 and 18 to stop plate 62 from rotating as bolt head 56 is rotated. Continued rotation of bolt head 56 pulls the plate 62 upwardly within the channel rail. Terminal ends of the length dimension (i.e., longest dimension) of the plate 62 are equipped with the locking protrusions 66 and 68 that project inward (i.e., perpendicularly upward as illustrated in FIGS. 3 and 5) toward the opposite end of the fastener (i.e., the head end as illustrated). Locking protrusions 66 and 68—at least one of which is critically required and both of which are preferred-go into the internal recesses 32 and 34 of the channel rail as the fastener head end 56 is threaded by turning shaft 58 into the nut end 60 carrying the transverse plate 62. (A locking protrusion behind each lip flange contributes to a locking relationship that holds the sides of the channel against outward bulging when watercraft weight is put on the channel rails.) Threaded movement is completed when the head end and nut end of the fastener are duly tightened to hold the bracket for the hull roller against movement on the channel rail.

Especially to be noted is that the width of the transverse plate cannot be greater than the width of the slot in the channel rail, and preferably is sufficiently short so that the width passes through slot 30 without binding (i.e., without frictional resistance). The length of the transverse plate has to be greater than the width of the slot 30 in the channel rail but less than (although near to) the internal width between the side walls of the channel rail. Although the plate length must be less than the internal width between the side walls of the channel rail, the plate length must have a terminal end part (e.g., a trailing corner terminal end part such as at 73 and 75 during rotation) that abuts the interior of the side walls to stop against the side wall and stop the plate 62 from rotating inside the channel rail. The abutting of the side wall by the plate's lengthwise terminal ends (i.e., the diagonal pointed corners) places the upward protrusions 66 and 68 at an orientation for entry into the internal recesses 32 and 34, respectively, of the channel rails as the parts of the fastener are threadedly fastened axially together.

Referring now back to FIG. 1, it should be noted that the water or entry end 6 is suitably equipped with an optional keel roller assembly that, as now well known, consists essentially of a central keel roller 76 on an axle mounted in end brackets having lateral flanges 78 which are bolted to the water end cross brace 39 of the ramp.

Proximate to the shore or stop end 8 of the ramp, one should mount a winch assembly. As illustrated in FIGS. 1 and 2, this assembly may have a telescoping winch mount beam 80 angling upward at about 45 degrees from the elongated channel rails (preferably at an angle of no more than 45 degrees or even fewer degrees) up from the level of the channel rails. Beam 80 angles upward and in a direction away from the water end 6. This mount beam 80 is braced at its foot end by bolting, especially at its lateral flanges 86 and 88 onto a cross brace member 37 located inwardly from the shore end 8 of the ramp. The winch mount beam 80 may be telescoping with a female part 82 and a male part 84 slidably related together in any suitable manner (analogous to the showing in FIG. 7) and then fastened by bolts after determining exactly the length desired for the winch mount beam 80. Easy support bracing of the winch mount beam 80 can be accomplished by using a rigid strap 90 (as of metal) laterally anchored at its side foot flanges 92 and 94 to the shore end terminal cross brace 35 after extending strap 90 as a bridge over a mid-location between the ends of the winch mount beam 80. The strap 90 is bolted or otherwise fastened to beam 80 at its bridge and serves to hold the winch mount beam 80 from being tilted (i.e., yanked upwardly) toward the water end 6 when a watercraft is pulled by the winch onto the hull-supporting roller assemblies 42. A winch 96 having a cable or strap 98 and handle 100 is on the beam 80. Also on beam 80 is a tie-down loop 102 for the bow end of watercraft to be latched and held on the ramp.

Figure 8:
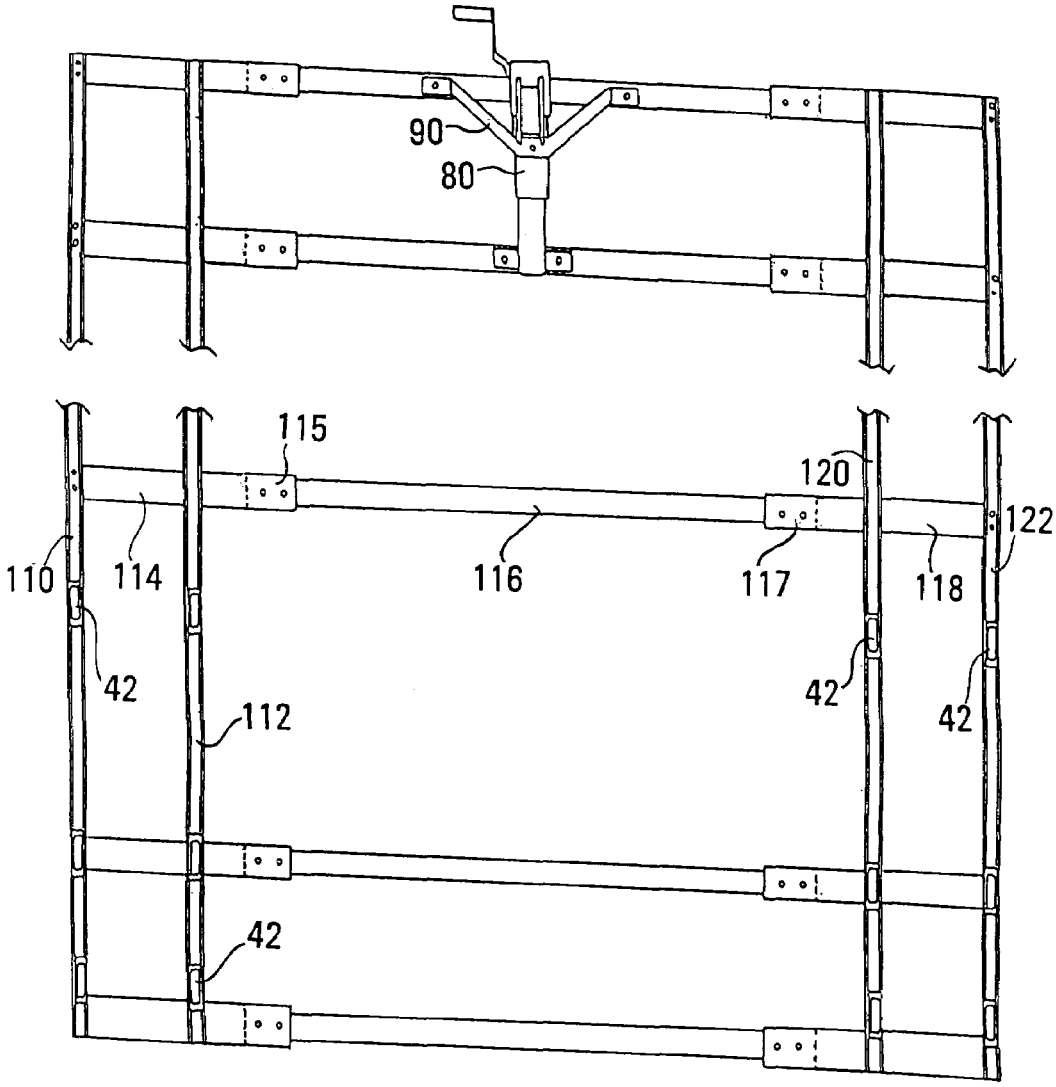
FIG. 8 is a schematic top plan view illustrating one form of ramp arrangement for a pontoon boat.

The usefulness of this invention extends to a tremendous variety of watercraft, not just personal watercraft or boats or canoes or the like, but also to various pontoon watercraft. Pontoon-type watercraft generally have two pontoons supporting a deck. Note FIG. 8. In that figure, a left pair of channel rails 110 and 112 of the type aforediscussed has hull-support roller assemblies 42 mounted thereon and a right pair of channel rails 120 and 122 also has hull-support roller assemblies 42 mounted thereon. The cross braces to which each pair of channel rails is mounted in spaced condition as desired are suitably formed of female parts 114 and 118 at each side with a male part 116 therebetween, and the female and male parts are united at telescoping portions by bolts 115 and 117. If desired, a keel roller may be added at the water end part of each pair of channel rails; but generally, keel rollers are unnecessary and undesirable for pontoon ramp structures. A winch arrangement at the shore end is desirable. Illustrated in FIG. 8 is a winch mount beam 80 and holding strap brace 90 comparable to the showing in FIG. 1. (It should be noted that the "hull-support roller assemblies" for pontoon ramps are the same or substantially the same as the hull-support roller assemblies for non-pontoon ramps of the invention. To name such structures differently, as for example, by calling them pontoon-support roller assemblies, would represent a needless attempt at distinction when there is none in fact. Such assemblies function to support pontoons the same as they function to support hulls of non-pontoon watercraft.)

Figure 9:
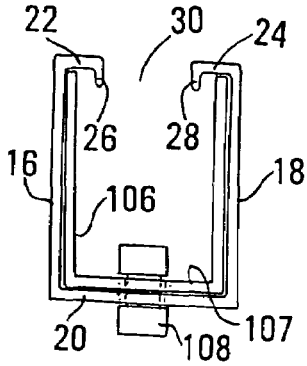
FIG. 9 is a cross-sectional view of a channel rail of the invention with a U-shaped connector bracket in place within a channel rail as it is used to unite two sections of channel rail.

Ideal practice of the invention involves maintaining disassembled parts of the total structure within the tolerance or limits of size that will permit formation of a package of a size acceptable to most parcel shipping entities such as the United States Postal Service, United Parcel Service, Federal Express (FedEx), etc. These organizations generally specify a maximum weight of 150 pounds per package and a maximum size of 108 inches (9 feet) in length as the maximum length, and 130 inches for the total of the length plus girth of the package. The new ramp of this invention is made up of components bolted or analogously fastened together. This contributes mightily to compliance with package restrictions of popular parcel shipment organizations, but sometimes channel rails even longer than 108 inches or 9 feet may be needed. A convenient way to form rails of longer length than 108 inches or 9 feet is to connect two rail sections in an end-to-end relationship using connecting brackets and bolts to hold the end-to-end rails together. A suitable connecting bracket need be nothing more than a U-shaped structure 106 as illustrated in FIG. 9. It has a short length and has a series of bolt holes in elongated alignment along its bottom or floor 107. The floor 20 of each channel section also has a series of bolt holes adjacent the ends placed in end-to-end relationship; and the connecting bracket 106 is long enough to extend into each end a sufficient extent to permit two or three bolt fastenings inwardly from each end. The connecting bracket 106 has a U shape snugly fitting within the channel rails along their floor 20 and sides 16 and 18, preferably with maximum surface contact with the floor and sides. This connecting bracket 106 cannot be inserted through the slot 30 of the channel rails. But it is easily slid into end portions of channel rail sections before the end portions are in fact pressed into abutting condition and united by bolts and nuts.

Figure 6:
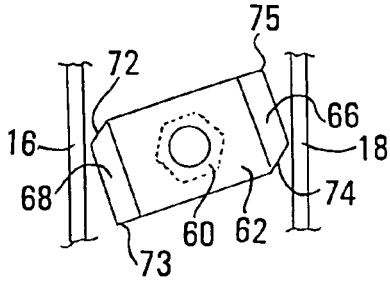
FIG. 6 is a schematic view looking downward and shows the plate of the roller bracket fastener between broken away side walls of a channel rail.
Figure 11:
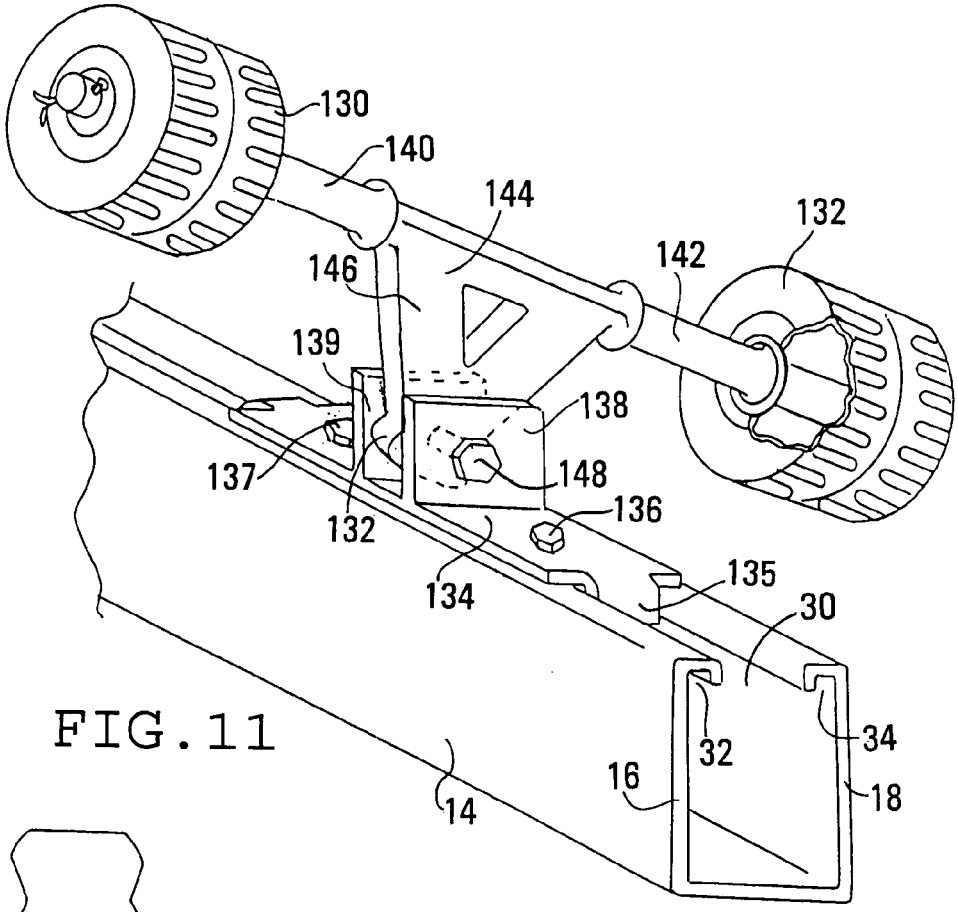
FIGS. 10, 11, 12, and 13 (compare to FIGS. 3, 4, 5, and 6) illustrate a variation for the hull-support assembly including its bracket and transverse plate.
Figure 12:
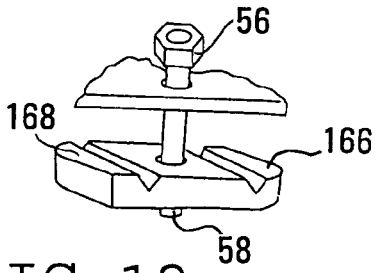
Figure 10:
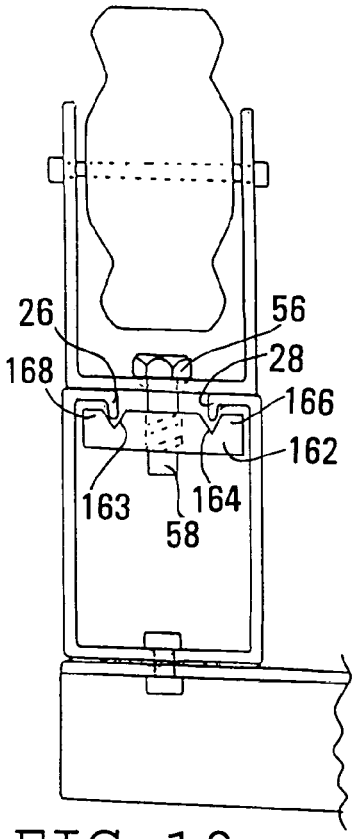
Figure 13:
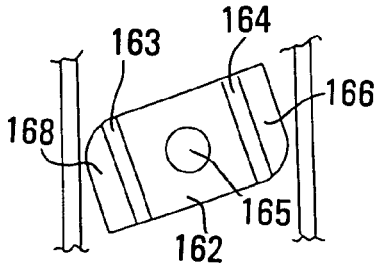

The transverse plate 62 of FIGS. 3, 5, and 6 is illustrated in FIGS. 10, 12, and 13 as a somewhat thicker transverse plate 162 on which parallel grooves 163 and 164 are present for mating relationship with the rail lip flanges 26 and 28. The lip flanges 26 and 28 fit into the grooves 163 and 164 as the fastener is tightened to fix a hull roller assembly to a rail. The transverse plate 162 is suitably equipped with a tapped (threaded) hole 165 (see FIG. 6) into which the threaded shaft 58 extends for tightening of the fastener (as by rotating the outer end of the fastener). By using a transverse plate with a threaded internal bore, one reduces loose parts such as a separately threaded nut. The grooving in a transverse plate as illustrated in FIGS. 10, 12, and 13 is effective to form the perpendicularly extending locking protrusions 166 and 168 for entering locking recesses 32 and 34 (see FIG. 11). In other words, the perpendicularly extending locking protrusions are protrusions for entering the locking recesses 32 and 34, and it is immaterial that the central portion of the grooved transverse plate 162 may be as thick as the protrusion portions or as thin as the plate illustrated in FIG. 3. However, a somewhat thickened central portion as in the illustrations of FIGS. 10, 12, and 13 is quite desirable for a threaded central bore in the plate.

The exact form for hull support roller assemblies of the invention can vary. An illustration of that is shown in FIG. 11. The hull support assembly can have two hull support rollers 130 and 132, or possibly even more, all supportively mounted on a mounting bracket of this invention. The mounting bracket illustrated has a floor panel 134 equipped with at least one fastener hole (and optionally but preferably two) through which a threaded shaft from a bolt head 136 and/or 137 of a fastener can extend. The bracket for the assembly of FIG. 11 has two fastener holes because it is relatively long and tight fastening of its entire length on a rail is desired. It also has two spaced parallel upright flanges 138 and 139 (in the nature of ears) that extend upwardly from the bracket floor 134; but in this instance, the bracket upright flanges are in planes transverse to the elongated length of the bracket floor 134 (instead of parallel to the floor as in FIG. 4).

The hull rollers 130 and 132 are spaced from each other and mounted on an axle or axle parts 140 and 142. Any of a variety of hull rollers may be used. Preferably the hull rollers are of the wobble roller type. Wobble rollers are well known and literally have the capability of wobbling and thus the capability of slightly adjusting the angularity or pivot of their axes of rotation with respect to the axis of the axle about which they rotate. Their ability to so adjust facilitates their capability to present the widest exterior tread surface or circumferential surface as a support for a watercraft hull contacted by the hull rollers.

Ideally, the hull rollers 130 and 132 are on axle parts 140 and 142 that extend from the central body axle part 144, and this arrangement of axle and hull rollers is preferably elevated by a brace 146 above a pivot mounting 148 for the brace and rollers. Thus, the lower portion of the brace 146 is mounted on a pivot shaft 148 that extends between and is supported by the upright flanges 138 and 139 of the bracket. The elevation over the rails of the axle parts 140, 144, and 142 (so as to elevate the rollers 130 and 132) above a side rail 14 in FIG. 11 is preferably at least about 3 inches up to about 12 inches and possibly more, and is done to avoid watercraft damage.

Packaging components of the new ramp into cartons acceptable to parcel shipment entities is easy. Cross braces having male and female parts, plus channel rails in the form of channel rail sections, can be in one carton. The rail sections should be slightly shorter than 108 inches but close to 108 inches, such as about 106 or 107 inches.

Metal is the preferred material out of which to form the components of the ramp except for a few components such as the rollers. The preferred metal is aluminum because of its light weight, but other lightweight metals may be used (although most are currently more expensive than aluminum). Rollers are best formed using synthetic plastic materials that preferably have at least some elastomeric properties. Rubber can be used. Nylon and polycarbonates can be useful where lubricating properties are needed as for the axis shaft of rollers or a coating on a surface.

There is thus described a watercraft ramp comprising a ladder-style frame having at least one pair of elongated lateral channel rails and a plurality of cross brace beams for holding the lateral channel rails in spaced apart condition. The ramp rails terminate at one end as a water or entry end and terminate at the other end as a shore or stop end. The elongated channel rails having a shape defined by two longitudinally extending parallel side walls with a longitudinal bottom edge and a longitudinal top edge for the side walls. A floor wall joins the bottom edge of the side walls and holds them in spaced apart condition. A top structure is formed by border flanges projecting inwardly from the top edge of the side walls. At the inward edge of the top border flanges are downwardly directed lip flanges that define a longitudinal slot in the top structure of the channel rails. Internal lock recesses inside the channel rails are defined by the lip flanges and the inwardly projecting border flanges and the upper part of the side walls.

The ramp should have at least six hull support assemblies mounted on a pair of spaced channel rails, and the hull support assemblies should be in laterally paired relationship across from each other and in longitudinally spaced relationship along the rails such that at least three hull support assemblies are on each channel rail. Each hull support assembly has a mounting bracket for at least one hull roller wherein the mounting bracket has a floor panel with a fastener hole extending vertically therethrough as well as spaced parallel upright flanges for accommodating a hull support roller or roller assembly therebetween and downward stabilizer flanges adapted to extend into the slot of a channel rail.

Further, a threaded fastener is used to hold the hull roller mounting bracket at any desired location along the length of a channel rail. The fastener has two major parts threadedly fastenable together along an axis common to each part. One part is a head end with a threaded shaft projecting axially inward therefrom toward the other part, and the other part is a nut end with an axially inward side (facing the head end) for threaded fastening axially on the threaded shaft. Either the head end or the nut end has a transverse plate extending radially outward therefrom and integrally united thereto so as to be oriented transverse to the axis of fastening. The transverse plate has a length between the opposite terminal ends of it and has a width across the length, with the length being longer than the width. At least one locking protrusion projects inward (toward the other part of the fastener) from the plate. The projection should be at or proximate to a terminal end, so as to be available for locking into an internal lock recess as of a channel rail during the fastening of the two parts of the fastener together. The width of the transverse plate is no greater than the width of the slot at the top of the channel rail, and the length of the transverse plate is greater than the width of the slot but less than the width between the internal surfaces of the side walls of the channel rail. Nevertheless, at least a portion of the radial length from the center of the plate must be sufficiently near the internal surface of the side walls so as to abut against a side wall and stop rotation of the plate. The result places the locking protrusions of the transverse plate at an orientation for entry into an internal lock recesses of a channel rail as the parts of the fastener are threadedly fastened axially together.

Figure 14:
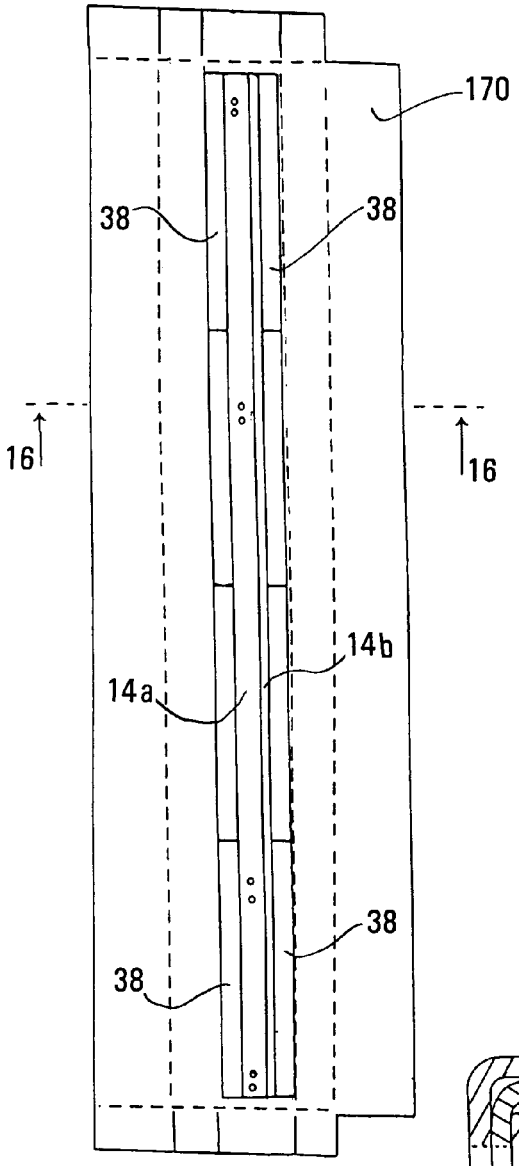
FIGS. 14 and 15 are top views of cartons of packaging in open condition to view contents.
Figure 16:
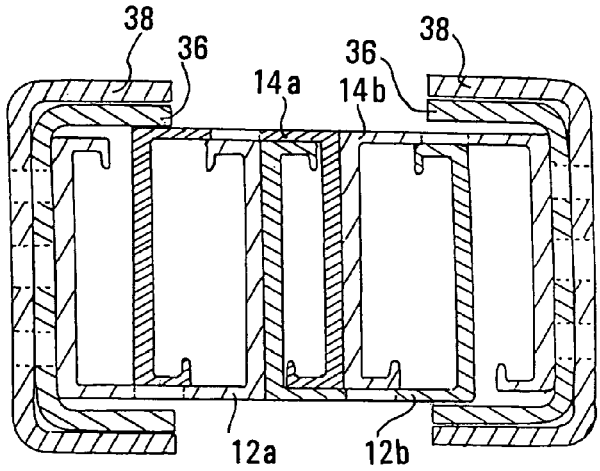
FIG. 16 is a cross-section on line 16—16 of FIG. 14 illustrating the compact nested and cradled condition for the components.

Unassembled components capable of convenient assembly to form a watercraft ramp can be packaged in cartons satisfying the aforesaid size limits of parcel shipment entities. As illustrated in FIGS. 14 and 16, rail sections 12*a* and 12*b* plus 14*a* and 14*b* (each about 107 inches in length) can be compactly packaged in a carton 170. They can be later joined together end-to-end by connectors 106 of FIG. 7 to form a long channel rail, such as one up to almost 18 feet. Additional rail sections can be used to make even longer total channel rail lengths.

FIGS. 14 and 16 will be noted to contain four rail sections and the male 36 and female 38 parts for at least six cross brace beams. The rail sections are packaged in a manner such that a first assembly of two rail sections in side-by-side relationship has the top structure of each rail section exposed so that both top structures face in the same direction. A second assembly of the remaining two rail sections in side-by-side relationship has the top structure of each rail section exposed in the opposite direction to that for the exposure of the top for the first assembly. The side walls of each rail section are therefore all aligned in parallel relationship and the slot openings into the interior recesses of the rail sections are therefore available to put the side walls of each assembly into the interior recesses of the other. This results in interleaving so that the side walls of one assembly extend into the recesses of the other assembly and vice versa. Then the interleaved rail sections are cradled on opposite lateral sides within the male part of a linear series of nested male and female parts of the cross brace beams 36 and 38. This makes for an extraordinarily compact but relatively long carton.

Figure 15:
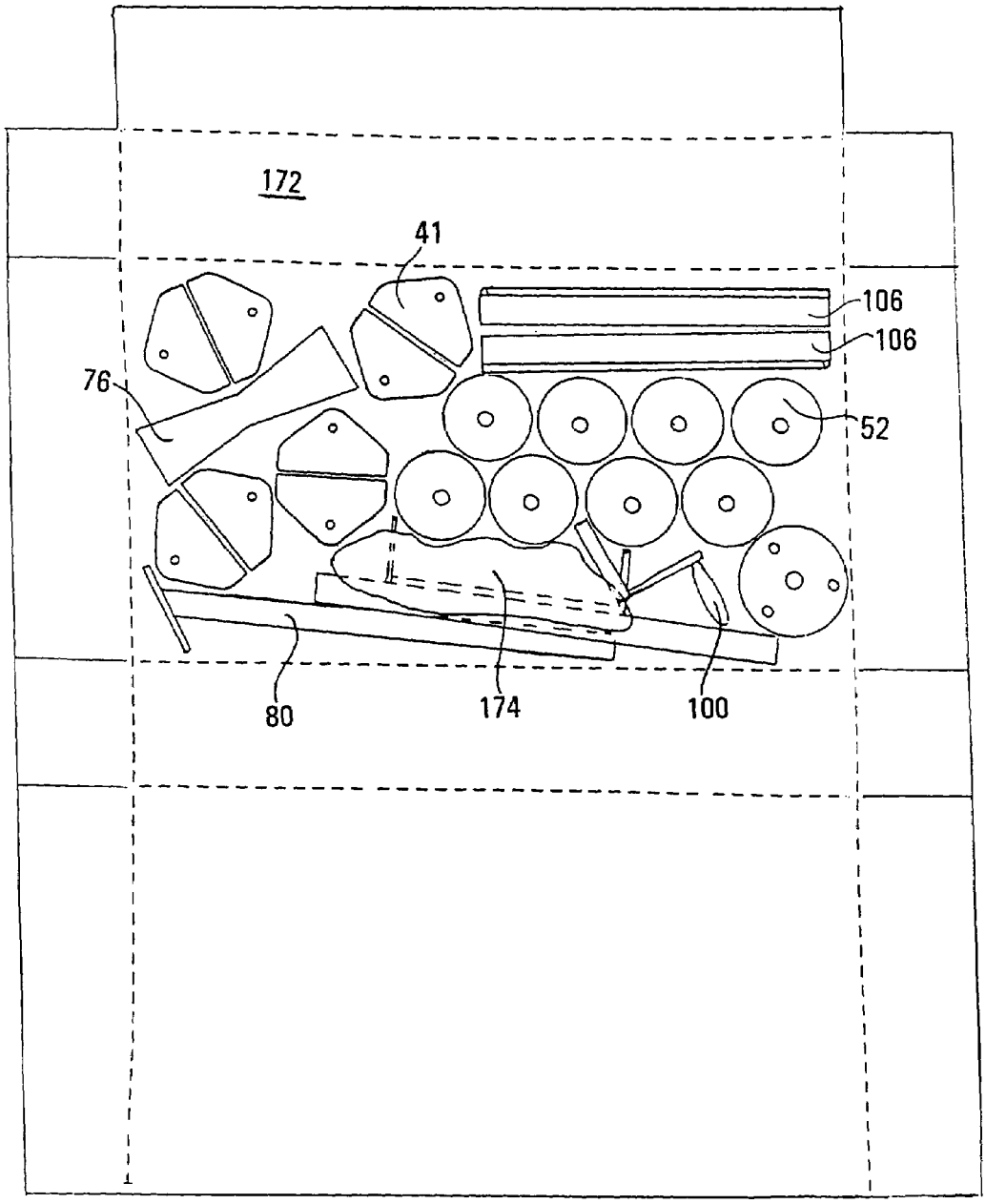

The components for forming at least six hull support assemblies (and preferably more) are noted in FIG. 15 and comprise mounting brackets 41 (suitably about 3.5 to 4 or 5 inches long and 3 inches high and about 2 inches wide) for rollers 52 (suitably of a diameter of about 3 inches and not over about 1.5 or so inches wide) and special fasteners for mounting on the rails as previously discussed. The fastener parts for mounting on the rails are best placed in a bag 174 within the shipping carton 172. The winch can be in this carton or a separate one. All remaining components for the winch end and the keel roller end can be included in this carton, and additional hardware such as plain nuts and bolts likewise included, as in a bag 174. Connectors 106 for end-to-end joining of rail sections are also suitably included in this carton 172. The packaging technique permits easy, fast shipment of the ramp components throughout the world.

Those skilled in the art will readily recognize that this invention may be embodied in still other specific forms than illustrated without departing from the spirit or essential characteristics of it.

That which is claimed is:

1. A watercraft ramp comprising a frame and a plurality of hull-support assemblies, (i) said frame having at least one pair of elongated channel rails held in laterally spaced condition, each said rail having a longitudinally aligned internal recess and a longitudinally aligned elongated slot for access into said internal recess, said slot being narrower in transverse width than the transverse width of said recess, and (ii) said hull-support assemblies being mounted in spaced relationship to each other on said channel rails, each said hull-support assembly comprising a mounting bracket, a fastener for fixing said bracket on a said rail, and at least one hull roller mounted on said bracket for supporting a watercraft, each said fastener including a locking part that is movable through a said rail slot into the internal recess of the rail for locking engagement of the bracket to the rail at any desired location along said rail slot, and said bracket having a stabilizer part cooperative with said slot to maintain alignment of the bracket on the rail.

2. The ramp of claim 1 wherein said locking part of said fastener comprises a transverse plate longer than it is wide, and wherein the width of said transverse plate is less than the width of said rail slot so that said transverse plate can pass through the elongated rail slot when the plate is oriented with its length parallel to the rail slot, the length of said transverse plate being greater than the width of said rail slot but less than the width of said rail internal recess, said length at its ends being equipped with stop members for abutment against an inside surface of said rail when said transverse plate is transversely oriented in said rail internal recess.

3. The ramp of claim 1 wherein said stabilizer part comprises a flange portion capable of extending into said rail slot.

4. The ramp of claim 1 wherein each said channel rail has a top structure including longitudinal border flanges that project inwardly from each side of the channel rail and wherein said border flanges have downwardly directed longitudinal lip flanges at the inward edge thereof, said longitudinal slot of said rail being defined by said lip flanges, and wherein said internal recess has internal lock recesses bordered by said inwardly projecting border flanges and by said lip flanges, and wherein said locking part of said fastener comprises a transverse metal plate having a length longer than its width and equipped with locking protrusions for entry into said internal lock recesses of said channel rails to effect said locking engagement of said bracket to the rail.

5. The ramp of claim 1 wherein said channel rails of said pair are held in spaced apart condition by cross brace beams and wherein said cross brace beams are telescope-able but fixed against telescoping movement on said ramp.

6. The ramp of claim 1 wherein one end of the elongated channel rails is called an entry end and the other end is called a stop end, said ramp having a winch assembly mounted proximate to said stop end on a telescope-able winch mount beam braced against tilt toward the entry end by a metal strap anchored on said frame.

7. The ramp of claim 1 wherein one end of the elongated rails is the entry end and a keel roller is mounted on said frame at said entry end.

8. The ramp of claim 1 wherein each said rail of said pair comprises two rail sections with an end of one said section abutting an end of the other said section and a connecting bracket extending over said abutting ends of said sections and fixed to each said rail.

9. The ramp of claim 1 wherein at least one of said hull roller assemblies is equipped with two hull rollers on a tiltable axle arrangement mounted on said bracket.

10. The ramp of claim 1 with features for receiving a pontoon watercraft thereupon, said features including a second pair of elongated channel rails in spaced apart relationship on said frame and in parallel spaced relationship to the pair of rails recited in claim 1, said channel rails of said second pair having all of the features and relationships specified for the channel rails and hull-support assemblies as specified in claim 1.

11. A watercraft ramp comprising (i) a ladder-style frame having at least one pair of elongated channel rails and a plurality of cross-brace beams for holding the lateral channel rails in laterally spaced condition, said rails terminating at one end as an entry end and terminating at the other end as a stop end, each said elongated channel rail having a shape defined by two longitudinally extending parallel side walls with a longitudinal bottom edge and a longitudinal top edge for each said side wall, a floor wall joining said bottom edge of said side walls, a top structure formed by longitudinal border flanges projecting inwardly from the top edge of said side walls and having at their inward edges downwardly directed lip flanges that define a longitudinal slot in the top structure of said channel rails as well as define internal lock recesses bordered by said lip flanges and said inwardly projecting border flanges and said upper part of said side walls, and (ii) at least six hull-support roller assemblies mounted on said channel rails in laterally paired relationship across from each other and in longitudinally spaced relationship along said rails such that at least three said hull-support roller assemblies are on each said channel rail, each said hull-support roller assembly having a mounting bracket and a fastener for holding said bracket at any desired location along the length of a said channel rail, (A) said mounting bracket having an elongated floor panel with a fastener hole extending vertically therethrough as well as upright flanges for supporting at least one hull roller and downward stabilizer flanges received within the slot of the said channel rail, (B) said fastener having two major parts threadedly fastenable together along an axis common to each part, one said part being a head end with a threaded shaft projecting axially inward therefrom and capable of extending through said fastener hole of said mounting bracket, the other said part being a nut end with an axially inward side for threaded fastening axially on said threaded shaft, either said head end or said nut end having a transverse metal plate extending radially outward therefrom and integrally united thereto so as to be oriented transverse to said axis of fastening, said transverse metal plate having a length between opposite terminal ends of it and having a width across said length, with the length longer than the width, and at least one locking protrusion projecting inward from said plate at a plate location proximate to a terminal end of said plate for locking into a said channel rail internal lock recess during a step of fastening of the two parts of said fastener together, said width of said transverse metal plate being no greater than the width of said slot of said channel rail and said length of said transverse metal plate being greater than the width of said slot and less than the internal width between the side walls of said channel rail but sufficiently near the internal width of said side walls to be stopped from rotating inside said channel rail by abutment against the side wall so as to place said transverse plate at an orientation for entry of said locking protrusion into a said internal lock recess of said channel rail as said parts of said fastener are threadedly fastened axially together with said shaft of said fastener extending through said fastener hole of said mounting bracket so as to fasten said bracket on a said channel rail with the stabilizer flanges of the bracket extending into the longitudinal slot of said channel rail.

12. The ramp of claim 11 having a locking protrusion at each end of said transverse plate so as to provide a locking protrusion for each internal lock recess of said channel rail.

13. The ramp of claim 11 wherein a plurality of said brackets have their upright flanges oriented parallel to the length of said bracket floor panel and a single hull roller is mounted thereon.

14. The ramp of claim 11 wherein a plurality of said hull-support roller assemblies have their upright flanges oriented transverse to the length of said bracket floor panel and two hull rollers on a tiltable axle arrangement are mounted thereon.

15. Two or more cartons of unassembled components capable of convenient assembly to form a watercraft ramp, said unassembled components comprising:

(i) components for forming a frame comprising

A. a pair of elongated channel rails, each said elongated channel rail having a shape defined by two longitudinally extending parallel side walls with a longitudinal bottom edge and a longitudinal top edge for each said side wall, a floor wall joining said bottom edge of said side walls, a top structure formed by longitudinal border flanges projecting inwardly from the top edge of said side walls and having at their inward edges downwardly directed lip flanges that define a longitudinal slot in the top structure as well as define internal lock recesses bordered by said lip flanges and said inwardly projecting border flanges and said upper part of said side walls, said rails having a length of at least about 5 feet and not greater than 9 feet, and B. a plurality of cross brace beams adapted for removable fastening to said rails to hold said rails in laterally spaced relationship, and (ii) components for forming at least six hull-support roller assemblies capable of being mounted on said channel rails of said frame at any desired location along the length of said channel rails, comprising for each said hull-support assembly (A) a mounting bracket having an elongated floor panel with a fastener hole extending vertically therethrough as well as upright flanges for supporting at least one hull roller and at least one downward stabilizer flange adapted to be received within the slot of a said channel rail, (B) a fastener having two major parts threadedly fastenable together along an axis common to each part, one said part being a head end with a threaded shaft projecting axially inward therefrom and capable of extending through said fastener hole of said mounting bracket, the other said part being a nut end with an axially inward side for threaded fastening axially on said threaded shaft, either said head end or said nut end having a transverse metal plate extending radially outward therefrom and integrally united thereto so as to be oriented perpendicular to said axis of fastening, said transverse metal plate having a length between opposite terminal ends of it and having a width across said length, with the length longer than the width, and at least one locking protrusion projecting inward from said plate at a plate location proximate to a terminal end of said plate for locking into a said internal lock recess during a step of fastening of the two parts of said fastener together, said width of said transverse metal plate being no greater than the width of said slot of said channel rail and said length of said transverse metal plate being greater than the width of said slot and less than the internal width between the side walls of said channel rail but sufficiently near the internal width of said side walls to be stopped from rotating inside said channel rail by abutment against the side wall so as to place said transverse plate at an orientation for entry of said locking protrusion into a said internal lock recess of said channel rail when said parts of said fastener are threadedly fastened axially together with said shaft of said fastener extending through said fastener hole of said mounting bracket so as to fasten said bracket on a said channel rail with the stabilizer flanges of the bracket extending into the longitudinal slot of said channel rail.

16. The cartons of claim 15, each having a weight no greater than 150 pounds and having a length dimension no greater than 108 inches and a length plus girth dimension not over 130 inches.

17. Two or more cartons of unassembled components capable of convenient assembly to form a watercraft ramp, said unassembled components comprising:

(i) components for forming a frame comprising

A four elongated channel rail sections for forming a pair of elongated channel rails, each said elongated channel rail being a composite formable by connecting two of said rail sections together in end-to-end relationship, each said elongated channel rail section having a shape defined by two longitudinally extending parallel side walls with a longitudinal bottom edge and a longitudinal top edge for each said side wall, a floor wall joining said bottom edge of said side walls, a top structure formed by longitudinal border flanges projecting inwardly from the top edge of said side walls and having at their inward edges downwardly directed lip flanges that define a longitudinal slot in the top structure as well as define internal lock recesses bordered by said lip flanges and said inwardly projecting border flanges and said upper part of said side walls, said rail sections having a length of at least about 5 feet and less than 9 feet, and B. at least six cross brace beams adapted for removable fastening to said rail sections to hold said rail sections in laterally spaced relationship, each said cross brace beam being comprised of a female part and a male part adjustably mateable to vary the length of the cross brace beam, and (ii) components for forming at least six hull-support roller assemblies capable of being mounted on said channel rail sections of said frame at any desired location along the length of said channel rail sections, comprising for each said hull-support assembly (A) a mounting bracket having an elongated floor panel with a fastener hole extending vertically therethrough as well as upright flanges for supporting at least one hull roller and at least one downward stabilizer flange adapted to be received within the slot of a said channel rail section, (B) a fastener having two major parts threadedly fastenable together along an axis common to each part, one said part being a head end with a threaded shaft projecting axially inward therefrom and capable of extending through said fastener hole of said mounting bracket, the other said part being a nut end with an axially inward side for threaded fastening axially on said threaded shaft, either said head end or said nut end having a transverse metal plate extending radially outward therefrom and integrally united thereto so as to be oriented perpendicular to said axis of fastening, said transverse metal plate having a length between opposite terminal ends of it and having a width across said length, with the length longer than the width, and at least one locking protrusion projecting inward from said plate at a plate location proximate to a terminal end of said plate for locking into a said internal lock recess during a step of fastening of the two parts of said fastener together, said width of said transverse metal plate being no greater than the width of said slot of said channel rail section and said length of said transverse metal plate being greater than the width of said slot and less than the internal width between the side walls of said channel rail section but sufficiently near the internal width of said side walls to be stopped from rotating inside said channel rail section by abutment against the side wall so as to place said transverse plate at an orientation for entry of said locking protrusion into a said internal lock recess of said channel rail section when said parts of said fastener are threadedly fastened axially together with said shaft of said fastener extending through said fastener hole of said mounting bracket so as to fasten said bracket on a said channel rail section with the stabilizer flanges of the bracket extending into the longitudinal slot of said channel rail section.

18. The carton of claim 17 wherein said four rail sections and said male and female parts of said six cross brace beams are packaged in nested and cradled relationship in one carton, said relationship being such that a first assembly of two said rail sections in side-by-side relationship with their top structures exposed in one direction and a second assembly of the remaining two said rail sections in side-by-side relationship with their stop structures exposed in the opposite direction have the side walls of the rail sections of each said assembly interleaved so that said side walls of one said assembly extend into the recesses of the rail sections of the other said assembly and vice versa, and wherein said interleaved rail sections are cradled on opposite sides within the male part of a series of said nested male and female parts of said cross brace beams.

* * * * *